United States Patent [19]

Watts

[11] Patent Number: 4,689,081

[45] Date of Patent: Aug. 25, 1987

[54] INVESTMENT CASTING METHOD AND STUCCO THEREFOR

[76] Inventor: Claude H. Watts, 32261 Cedar Rd., Mayfield Heights, Ohio 44124

[21] Appl. No.: 692,320

[22] Filed: Jan. 16, 1985

Related U.S. Application Data

[63] Continuation of Ser. No. 431,338, Sep. 30, 1982, abandoned.

[51] Int. Cl.[4] ..... B28B 7/34; C04B 35/14

[52] U.S. Cl. ..... 106/38.4; 106/38.51; 164/21; 428/403; 428/407; 523/139

[58] Field of Search ..... 164/21; 523/139; 260/DIG. 40; 428/403, 407; 106/38.5, 38.4

[56] References Cited

U.S. PATENT DOCUMENTS

| | | | |
|---|---|---|---|
| 2,912,729 | 11/1959 | Webb | 106/38.22 |
| 3,165,799 | 1/1965 | Watts | 106/38.22 |
| 3,362,463 | 1/1968 | Manginecci | 164/34 |
| 3,367,393 | 2/1968 | Lenahan | 164/34 |
| 3,903,950 | 9/1975 | Lirones | 164/28 |
| 3,953,657 | 4/1976 | Yamaguchi et al. | 428/407 |
| 3,993,620 | 11/1976 | Yamanishi et al. | 106/38.22 |
| 4,036,928 | 7/1977 | Valenta | 264/118 |
| 4,061,807 | 12/1977 | Shaler et al. | 428/402 |
| 4,288,245 | 9/1981 | Roorda et al. | 428/402 |
| 4,311,609 | 1/1982 | Wagner et al. | 428/402 |
| 4,332,910 | 6/1982 | Dunworth | 501/106 |

*Primary Examiner*—Robert A. Wax

*Attorney, Agent, or Firm*—Woodling, Krost & Rust

[57] ABSTRACT

A special stucco for use in the construction of shell molds for investment casting is disclosed. The stucco particles comprise refractory powder held together by a binder which volatilizes or otherwise disintegrates at firing temperatures. Since the particles lose their structural integrity in the firing process, the shell mold may be more easily broken away from the finished casting.

10 Claims, 2 Drawing Figures

THERMAL EXPANSION CURVE FOR CERAMIC SHELL MADE WITH #7 QUARTZ SILICA STUCCO

THERMAL EXPANSION CURVE FOR CERAMIC SHELL MADE WITH ARTIFICIAL STUCCO

INVESTMENT CASTING METHOD AND STUCCO THEREFOR

This is a continuation of co-pending application Ser. No. 431,338, filed on Sept. 30, 1982, now abandoned.

BACKGROUND OF THE INVENTION

This invention relates to the art of investment casting, and more particularly to new and novel composition and combinations of shell building materials to provide an improved shell mold.

The standard methods of forming a ceramic shell mold over a heat destructable pattern are well known in the art. Basically these steps include the following:

(1) A set-up of heat destructable patterns, such as wax patterns, is prepared on a suitable runner system.

(2) A primer slurry is prepared consisting of a finely divided (about 200 to 325 mesh) refractory powder or "flour" (fused silica, zirconium silicate, or calcined alumino-silicate) and a binder such as 15% to 30% silica sol, plus a small addition of wetting agent and antifoam agent. Ethyl silicate binders are also used. These are blended in suitable proportions to form a slurry which is kept in suspension by mechanical agitation.

(3) The set-up is dipped into the slurry to coat all surfaces. The set-up is then withdrawn and the excess slurry allowed to drain off. The set-up is manipulated either by hand or mechanically so as to promote as nearly uniform a coverage of the set-up and patterns by the refractory slurry as possible.

(4) After draining to a uniform coverage and while the refractory slurry is still wet, the entire assembly is treated, either by sprinkling on or by use of a fluid bed, with a stucco material. That stucco is a refractory grain such as calcined alumino-silicate (Molochite or Mulgrain), fused silica, zirconium silicate or aluminum oxide. The particle size of these stucco grains is usually not coarser than a U.S. 50 mesh and on a U.S. 120 screen. The major portion will be through a U.S. 50 mesh and on a U.S. 120 screen.

(5) The first slurry coat is now allowed to dry under strictly controlled temperature and humidity conditions.

(6) After drying and prior to the second dip coat the entire set-up is immersed in water or in a pre-wet solution of 15% silica sol plus a small addition of wetting agent. The purpose of the pre-wet dip is to ensure a uniform coverage of the slurry coated patterns without the formation of entrapped air bubbles.

(7) After quickly immersing the set-up in the pre-wet solution (in and out immediately) the excess pre-wet solution is allowed to drain off for about 30 to 60 seconds. Steps 3, 4 and 5 are then repeated. The slurry used for the second dip is the same as for the first coat.

(8) The remaining slurry coats are applied using a socalled "back-up slurry". The composition may be similar to the slurry used for the primer coats, however, the particle size of the refractory flour in the slurry is usually a little larger. The stucco material applied to the back-up coats is usually considerably coarser that that used for the primer coats. A typical sieve analysis for a suitable back-up stucco is as follows: about 20% on a U.S. 20 screen, about 40% on a U.S. 30 screen, about 30% on a U.S. 40 screen, about 10% on a U.S. 50 screen, and not to exceed about 2% through a U.S. 50 screen. Actual particle size distribution may vary considerably and suitable stucco materials are generally of a size through a U.S. 18 screen and on a U.S. 50 screen.

(9) The steps of dipping, draining, stuccoing, and drying are repeated until the desired shell thickness is obtained. Usually about five more dips are applied for a total of seven coats, although more or fewer coats may be used depending upon the size and configuration of the parts to be cast and the total weight of the metal to be poured into the finished shell. The pre-wet step used between the first and second slurry coat may also be used between the second and third slurry coat. Although additional pre-wet steps may be used in special circumstances, it is not ordinarily required for the production of satisfactory shell molds.

After completing the series of dipping, draining, stuccoing and drying steps the finished shell mold is dried thoroughly, usually overnight. This is followed by the usual steps of dewaxing, firing, casting, cooling, knock-out, salt bath, cut-off, sand blasting and other necessary after cast operations all well known in the art.

The materials, processes, and techniques generally used as described above are not completely satisfactory in many respects and there is considerable room for improvement in several areas.

For example, the ceramic shell mold becomes very hard after firing and casting. Thus the removal of the ceramic mold material to recover the metal castings becomes very difficult and expensive. A pneumatic hammer is usually employed to remove as much refractory shell material as possible from the cast tree. In some instances the mechanical vibration is so severe that the metal castings are cracked or otherwise damaged.

After the knock-out operation there usually remains a considerable amount of refractory shell material that must be removed. The is particularly true for set-ups of relatively small parts that are spaced closely together resulting in a dense packing of solid refractory material.

In addition, parts having holes, slots, and internal configurations usually trap shell material which many times cannot be removed by mechanical vibration. Usually a molten salt bath of caustic soda (sodium hydroxide) is used to dissolve the remaining shell material. This, too, is a time consuming and expensive operation. The caustic soda soon becomes neutralized or spent and will no longer remove the shell material from the casting. The salt bath must be cleaned and rejuvenated by removing the sludge and discarding a portion of the spent salt, so that fresh sodium hydroxide can be added. This is a hot, dirty, and hazardous operation. Moreover, the safe disposal of the spent caustic soda is now an increasingly serious environmental problem.

Another area needing improvement has to do with the permeability of the shell mold. A high permeability is needed to permit the hot gases in the mold to escape as the molten metal is cast into the mold.

Still another area for improvement is in the combination of a shell mold with extremely high permeability together with very good strength characteristics.

One attempt to solve some of these difficulties has been to substitute a special refractory slurry for one or more of the intermediate layers. Usually this has been accomplished at the third or third and fourth dip coats. It has long been known to prepare slurries comprising a refractory powder and an organic binder such as polyvinyl alcohol. See U.S. Pat. No. 3,165,799 issued Jan. 19, 1965, Column 5, lines 32 and 33, and lines 44 to 55.

See also U.S. Pat. No. 3,903,950 issued Sept. 9, 1975, and U.S. Pat. No. 2,912,729, issued Nov. 17, 1959.

An intermediate layer or layers such as this bound only with an organic binder will revert to a loose, free flowing powder after heating to a high enough temperature to burn off and remove the organic binder. This approach does indeed improve the ease with which the bulk of the ceramic shell material is removed by mechanical vibration after casting. However, it is not entirely satisfactory. One difficulty is that the one or two primer coats that are applied prior to the intermediate coats containing the organic binder polyvinyl alcohol are not attached to the back-up coats. Thus, there is a loosely filled space or gap in the mold. Many times the force or weight of the molten metal will cause the first two coats (precoat layers) to buckle into the gap or space left by the intermediate layer. This results in a defective casting. Furthermore, the overall strength of the shell mold is reduced because the intermediate layer produces a laminating effect with no bond between the primer layers and the back-up players.

Another difficulty arises if the ceramic mold should crack during any of the processing steps. The free flowing refractory powder tends to flow out of the interior of the built up shell construction and may be deposited within the mold cavity or cavities, causing ceramic inclusions in the metal casting.

Another approach to solve some of these difficulties has been to attempt to use expanded or foamed plastic (poly-styrene) beads or particles as a stuccoing material. See U.S. Pat. No. 3,362,463 issued Jan. 9, 1968. This process is not used in production, but only occasionally for certain special applications. This is presumably because, as my experiments have shown, it is difficult to apply the particulate material to produce a satisfactory coat. When the application is attempted by sieving, the foam particles do not go through the screen easily, and those which do generally will come lightly to rest on the surface of the slurry rather than become embedded in it. Moreover, they are not deposited on the internal cored surfaces. If the set-up is plunged into a bed of foam particle stucco, other difficulties ensue. The particles adhere to each other, blocking openings to cored passages and blocking particle access to some portions of external surfaces. The use of this material is therefore limited to simple shapes having external surfaces only and with parts spaced sufficiently far apart so that contact of the foamed polystyrene with the wet slurry surface is possible.

Yet another problem in the investment casting industry has been the rapid growth of that industry and a consequent lack of capacity in manufacturing facilities to produce stucco economically and in sufficient quantities.

In the past, stucco materials such as Molochite, Calamo, Flintgrain, Mulgrain, and fused silica have been widely used for the production of ceramic shell molds. Molochite, Calamo, Flintgrain and Mulgrain* are all trade names for refractory materials and stuccoes that can be described chemically as calcined aluminosilicates. They have found widespread use because they are highly refractory and they have a fairly low and uniform coefficient of thermal expansion. A typical example of the linear thermal expansion of a built-up shell mold comprising seven slury coats and seven stucco layers will show an approximately straight line curve from room temperature to 2000° F. and an increase in length of about 0.4%. This low and uniform thermal expansion is very desirable in shell molding because it minimizes cracking of the shell mold during the firing cycle due to possible differential thermal expansion.

* Molochite is prepared from a source of very pure clay mined in England and is available in this country from Casting Supply House in New York. Calamo and Flintgrain are available from Harbison Walker Refractories, Inc. and Mulgrain Stuccoes are products of C.E. Minerals and are available from Pre-Vest, Inc. Cleveland, Ohio.

Quartz occurs naturally in large quantities in the United States. Also, there are large deposits of very pure, high grade quartz. And it is very economical.

However, it has not been used to any great extent in the investment casting industry for shell molding, because of its high thermal expansion. An abrupt thermal expansion occurs as quartz undergoes a transformation from low quartz to high quartz at the inversion temperature of 573° C. (1063° F.). This abrupt increase in volume approximates about 0.9%. The total volumetric expansion which occurs between 600° F. and 1100° F. is about 3.2%. The coefficient of volume expansion for solids is approximately three times the linear coefficient. Therefore the total linear expansion of quartz which occurs between 600° F. and 1100° F. can be figured at about 1.06%. This high coefficient of thermal expansion, and particularly the abrupt increase in volume as the quartz undergoes transformation from low quartz to high quartz, has precluded the use of this material as a suitable refractory for making shell molds heretofore.

In accordance with the above, it is an object of my invention to provide an artificial stucco the use of which results in a shell mold which may be more readily removed than heretofore.

Another object of my invention is to provide a stucco which if desired may be used to produce shell molds with both high permeability and good strength.

A further object of my invention is to provide a stucco which is as easy to use as stuccoes previously known but has the desirable qualities above listed.

Yet another object of my invention is to provide a stucco with favorable thermal expansion properties, but which can be made of economical raw materials which themselves do not possess such favorable properties.

SUMMARY OF THE INVENTION

The concept of this invention involves the use of commonly used primer and back-up slurries using the high temperature silica sol or ethyl silicate binder in each of the slurry dips. Standard stuccoes are also used for the primer coat or first two coats if desired and also for some of the back-up coats. The invention resides in the composition, preparation and use of special stucco for intermediate coats.

Stuccoes in general use by the investment casting industry heretofore have consisted of solid grains of refractory particles of certain specified particle sizes. Furthermore these grains are substantially unaffected in either size, shape, or hardness by the firing cycle. In contrast, my invention is an entirely different artificial stucco type material. This artificial stucco is made by using a refractory powder (200 to 325 mesh particle size) mixed into a suitable condition with a water solution of an organic binder such as polyvinyl acetate emulsion. Other organic binders such as polyvinyl alcohol, various gums, or starches may also be used, but polyvinyl acetate is a preferred organic binder. A blend of refractory particles including some as coarse as 100 mesh may also be used. Suitable refractory powders include the group of silica flour, zirconium silicate, aluminum oxide, fused silica and calcined alumino-silicate. The refractory powder may be any one of the above, or a mixture of two or more. These materials are thoroughly mulled so that all surfaces of the refractory powder are completely wetted by the binder to provide a strong bond between the particles on drying.

The mulled material is pellitized in equipment such as that manufactured by the California Pellet Mill Co., Crawfordsville, Ind. The pellets are then dried, crumbled and screened to provide an artificial stucco of the desired grain size distribution.

This artificial stucco is then used in place of the customarily used stucco for one or more of the intermediate slurry dips.

The organic binder is burned off during the firing cycle leaving a stucco shaped particle comprising a powdered refractory and voids left by the space occupied by the organic binder. The fired particle has very little strength and is easily crushed although there may be sufficient strength for the particles to maintain their shape.

The cross section of this improved shell mold before firing can be described as a honeycomb structure comprising artificial stucco particles having an organic binder surrounded by a thin layer or web of hardened refractory slurry containing a high temperature binder.

After firing, the very low strength of the artificial stucco particles is such that shell removal after casting is easily accomplished by mechanical vibration. This greatly reduces the danger of damaging or cracking the metal casting, because the degree of mechanical vibration required is greatly reduced. Also the amount of shell material removed by the knockout operation is substantially increased, thereby reducing the volume of ceramic material that must be removed by the salt bath.

In some instances it may be desirable to use the artificial stucco on all but the last slurry dip. This would provide a shell mold with a major portion consisting of the honeycomb type structure providing a fairly strong mold combined with an exceptionally high degree of permeability.

One of the unique physical characteristics of the product of this invention is that an artificial stucco made using silica flour, bonded with an organic binder such as vinyl acetate and processed to form an artificial stucco granule, will not have a high thermal expansion. The reason for this desirable result is as follows:

(1) The thermal expansion of powdered silica in the range from room temperature to 300° F., during which the artificial stucco tends to act as a solid granule, is relative small.

(2) Above 300° F. the organic binder starts to decompose. Voids are formed around the individual silica particles and expansion is allowed to take place without any significant increase in size of the original stucco particles.

(3) As further heating takes place the organic binder is completely removed by oxidation and the voids left are more than adequate to accommodate the high thermal expansion of the quarts powder.

Thus a very satisfactory and economical stucco type material is available for use by the industry. And it is made from raw materials that are (1) abundant, (2) of high purity, and (3) readily available in the United States.

Because of the negligible thermal expansion when the stucco is made with silica flour, it can be used satisfactorily in combination with other low expanding refractory materials commonly used as the filler in the slurries containing the high temperature binders. Of course, other refractory powders than silica flour may be used, but the economy and convenience of the silica flour makes it a preferred constituent.

DETAILED DESCRIPTION OF THE INVENTION

Figure 1:
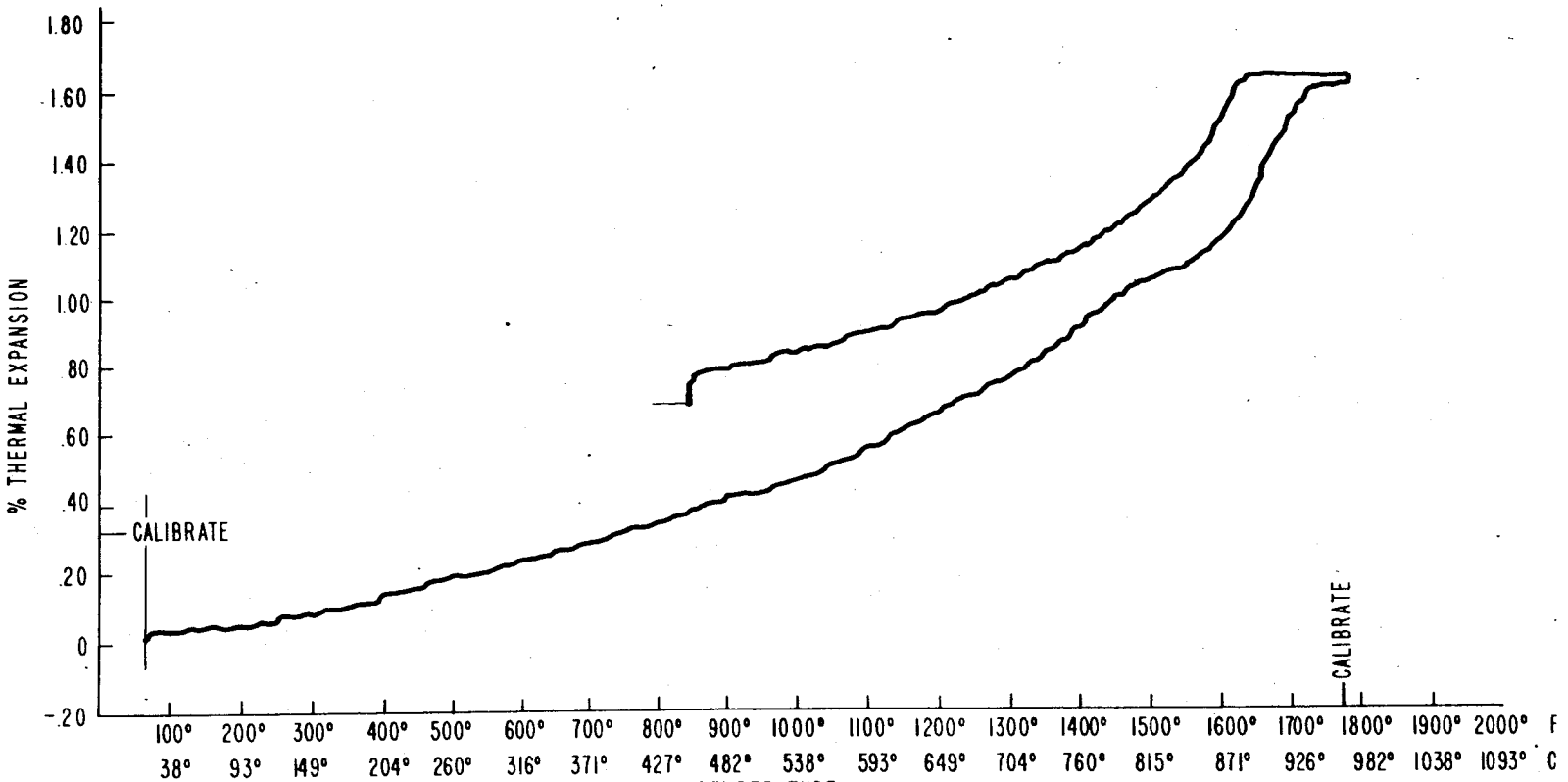

Following is a description of the procedure used to produce about 50 pounds of artificial stucco material having a suitable grain size distribution.

This work was done in the Research facilities of the California Pellet Mill Co., Crawfordsville, Ind.

The following materials were added to a Hobart Mixer Size A-200-20 and mixed thoroughly for about 10 minutes:

5,000 grams 200 Mesh Silica Flour
500 ml. Polyco 117 SS**
500 ml. Water

**Note: Polyco 117 SS is a vinyl acetate homopolymer emulsion made by the Borden Chemical Co.

This mixture produced a damp powder, which when squeezed in the hand tended to stick together.

This was fed into the hopper of a CPM Model CL-Type 3 2 Hp Pellet Mill. The die had 3/16" hole sizes with a 1" land. The mixture pelletized very satisfactorily. After running for about 15 minutes the die became warm due to friction and the pellets being collected developed a temperature of about 120° F. Moisture could be seen vaporizing above the collection pan. The pellets were spread out on a paper on the floor. After cooling, the pellets were much too soft to be processed through the crumbler. About two dozen pellets were placed in an infra-red oven and dried for about 10 minutes. After cooling down these were tested for hardness by snapping with the fingers and also by the fingernail test. This test showed that sufficient binder was present to produce a suitable hardness provided that the pellets were dried sufficiently. The balance of this test batch was placed in a large metal pan and gently heated over a propane flame for about 30 minutes. The pellets were stirred occasionally to provide uniform heating and to prevent burning. This material was then cooled and processed through a Model 624-S California Pellet Mill Crumbler. The product was then put though a series of screens to produce an artificial stucco material with a particle size through a U.S. 18 mesh screen and on a U.S. 50 mesh screen. This material was deemed to be satisfactory for carrying out actual casting tests. Additional mixes were processed according to the procedures outlined above.

Following are specific examples of tests run to demonstrate the practical use of this invention in a production situation. The artificial stucco prepared as described above was used for building a shell mold in test numbers 1 and 2. In test No. 1 the artificial stucco was used to stucco slurry dip number 3 and 4. In Test No. 2 the artificial stucco was used for slurry dip numbers 3, 4, 5 and 6. Test No. 3 was a control test for comparison purposes. Standard refractory slurries, stuccoes, and binders in common use for at least the last 10 years were used for this control test. They are also the materials used on a production basis at the precision casting foundry where these tests were conducted.

Three identical wax set-ups were prepared each having 11 wax patterns. The wax centre tree was 2 inches in diameter by 15 inches long. A metal hook for handling purposes was embedded in the pouring cup. Three wax patterns identified as gun receiver parts were wax welded to the centre tree at the end opposite the pouring cup. Eight wax patterns identified as carrier parts were wax welded at the pouring cup end of the tree.

Formula for primer coat 18 lbs. Silica Sol (Nyacol 1430)
7 lbs. Water
40 mls. DCH-10 (Anti-Foam)
80 mls. Victawet 12 (Wetting Agent)
55 lbs. Ranco-Sil #4 Powder
28 lbs. Zircon Flour The above materials were mixed in a suitable container and in sufficient quantities to provide enough slurry for dipping purposes. They were mixed with a Lightnin Type mixer for about two hours or until the entrained air was eliminated. The viscosity was adjusted by adding either liquid or refractory powder to give a 36 second reading using a No. 5 Zahn Cup.

Note: Nyacol 1430; DCH-10; Victawet 12 and Ranco-Sil #4 are all trade names of materials available from the Ransom and Randolph Co., Toledo, Ohio.

Formula for Back-up Coat 18 lbs. Silica Sol (Nyacol 1430)
18 lbs. Water
55 lbs. Ranco-Sil #2

The above materials were mixed in a suitable container and in sufficient quantities to provide enough slurry for dipping purposes. They were mixed with a Lightnin Type mixer until the entrained air was eliminated. The viscosity was adjusted by adding either liquid or refractory powder to give a 14 second reading using a #4 Zahn cup.

Note: Ranco-Sil #2 is the trade name of a fused silica powder available from the Ransom and Randolph Co., Toledo, Ohio.

Formula for Pre-Wet Solution 20 lbs. Silica Sol (Nyacol 1430)
20 lbs. Water
40 mls. Victawet 12 (Wetting Agent)

The above materials were mixed in a suitable container and in sufficient quantities to provide enough solution for dipping purposes.

All three test shells were thoroughly washed to remove dirt and traces of mold lubricant by immersing with agitation in a container of Ultrawash Solution available from Marketeers, Inc., Cleveland, Ohio. The set-ups were thoroughly dried for one hour using forced air.

The shell mold for each test set-up was prepared by dipping, draining, stuccoing and drying according to the following schedules.

| Coat No. | Slurry | Time | Stucco |
|---|---|---|---|
| | | Test No. 1 | |
| 1 | Primer | 2:15 p.m. | Granular Zircon |
| | Pre-Wet | 3:30 p.m. | |
| 2 | Primer | 3:32 p.m. | Granular Zircon |
| | Pre-Wet | 10:30 a.m. | |
| 3 | Back-Up | 10:32 a.m. | Artificial Stucco |
| 4 | Back-Up | 2:00 p.m. | Artificial Stucco |
| 5 | Back-Up | 4:30 p.m. | Ranco-Sil "B" |
| 6 | Back-Up | 9:00 a.m. | Ranco-Sil "B" |

-continued

| Coat No. | Slurry | Time | Stucco |
|---|---|---|---|
| 7 | Back-Up | 11:30 a.m. | No stucco on last dip |
| | | Test No. 2 | |
| 1 | Primer | 2:30 p.m. | Granular Zircon |
| | Pre-Wet | 3:35 p.m. | |
| 2 | Primer | 3:37 p.m. | Granular Zircon |
| | Pre-Wet | 10:35 a.m. | |
| 3 | Back-Up | 10:37 p.m. | Artificial Stucco |
| 4 | Back-Up | 2:05 p.m. | Artificial Stucco |
| 5 | Back-Up | 4:35 p.m. | Artificial Stucco |
| 6 | Back-Up | 9:05 a.m. | Artificial Stucco |
| 7 | Back-Up | 11:35 a.m. | No stucco on last dip |
| | | Test No. 3 (Control) | |
| 1 | Primer | 2:25 p.m. | Granular Zircon |
| | Pre-Wet | 3:40 p.m. | |
| 2 | Primer | 3:42 p.m. | Granular Zircon |
| | Pre-Wet | 10:40 a.m. | |
| 3 | Back-Up | 10:42 a.m. | Ranco-Sil "B" |
| 4 | Back-Up | 2:10 p.m. | Ranco-Sil "B" |
| 5 | Back-Up | 4:40 p.m. | Ranco-Sil "B" |
| 6 | Back-Up | 9:10 a.m. | Ranco-Sil "B" |
| 7 | Back-Up | 11:40 a.m. | No stucco on last dip |

Note: Ranco-Sil "B" is a fused silica stucco material available from the Ransom and Randolph Co., Toledo, Ohio.

The procedures used for de-waxing, firing, and casting were the same for all three test shells and were as follows:

De-wax in an infra-red dewaxing oven for 10 minutes at 3:45 p.m. on May 10, 1982. Load into burn-out oven at 8:00 p.m. on May 10, 1982 and burn-out overnight at 1800° F.

Cast by gravity pour at 7:45 a.m. May 11, 1982. Metal 4140. Pouring temperature 2950° F.

All three test shells were allowed to cool down to room temperature before the knock-out operation.

Results of Knock-Out Tests

Test No. 1—Knocked out using a pnematic hammer for 25 seconds. Practically all of the shell material was removed from all external surfaces including the center tree. The artificial stucco applied to slurry coats 3 and 4 had deteriorated in strength sufficiently so that substantially all of the back-up coats on both interior and exterior surfaces were removed by the mechanical vibration. There was some shell material consisting of the first two primer coats still remaining on internal surfaces. The results are considered to be excellent. It is estimated that 90 to 95% of the shell material was removed. Further vibration did not remove any additional shell material.

Test No. 2—The results for test No. 2 are exactly the same as for Test No. 1. No improvement in knock-out could be seen when using the artificial stucco for back-up coats 3, 4, 5 and 6 compared to Test No. 1 where the artificial stucco was used for only coat numbers 3 and 4.

Test No. 3—Knocked-out using a pneumatic hammer for 25 seconds. There was a great difference in the amount of shell material removed comparing test numbers 1 and 2 with the control Test No. 3. It is estimated that 90 to 95% of the shell material was removed for test 1 and 2 while only 50 to 60% was removed for Test No. 3. Very little shell material was removed around the center tree as well as on the internal surfaces. Additional vibration failed to remove any substantial addition of shell material.

The advantage of using artificial stucco for slurry dips 3 and 4 to improve shell removal at knock-out at has been clearly demonstrated. Moreover, it is apparent that a shell mold, prepared using stucco material that disintegrates due to the elimination by oxidation of an organic binder to produce an easily friable structure, will be much more permeable than a shell produced using solid grain stucco that is unaffected by firing and presents a solid impermeable block to escaping gases.

Thermal expansion test were run on ceramic shell slurries and stuccoes to show the actual expansion of shell compositions when using the artificial stucco of this invention prepared using 200 mesh silica flour compared with quartz silica stucco having a particle size distribution predominantly −20 mesh to +70 mesh.

Prime coat and back-up slurries for producing thermal expansion test specimens were prepared as follows:

Formula for Prime Coat 18 lbs. Silica Sol (Nyacol 1430)
7 lbs. Water
40 mls. DCH-10 (Anti-Foam)
80 mls. Victawet 12 (Wetting Agent)
55 lbs. Ranco-Sil #4 Powder (Fused Silica)
28 lbvs. Zircon Flour Formula for Back-Up Coat 18 lbs. Silica Sol (Nyacol 1430)
18 lbs. Water
55 lbs. Ranco-Sil #2 (Fused Silica)

The materials for the prime coat were added to a suitable container, and the materials for the back-up added to a second container. The materials in each container were mixed thoroughly using a Lightnin Type Mixer. Mixing was continued for about 2 hours until the entrained air was eliminated.

The viscosity was adjusted to the following readings:
Prime Coat—No. 5 Zahn Cup, 36 seconds
Back-Up Coat—No. 4 Zahn Cup, 14 seconds
Note: Nyacol 1430, DCH-10, Victawet 12, Ranco-Sil #4, Ranco-Sil #2, and Zircon Flour are all available from the Ransom and Randolph Company, Toledo, Ohio.

The thermal expansion test specimen for Test No. 1 was prepared using #7 quartz silica available from Pre-Vest, Cleveland, Ohio as the stucco material and having the following sieve analysis:

| U.S. Sieve No. | % ON |
|---|---|
| 30 | 2.5 |
| 40 | 17.9 |
| 50 | 48.8 |
| 70 | 24.9 |
| 100 | 4.5 |
| 140 | 1.1 |
| 200 | .1 |

The thermal expansion test specimen for Test No. 2 was prepared using the artificial stucco of this invention using 200 mesh silica flour bonded with Polyco 117 SS as described above. The particle size was through a U.S. 18 mesh screen and on a U.S. 50 mesh screen.

Two wire rods about 3/32 inches in diameter by 8 inches long were prepared for forming the test specimens by applying a thin film of wax.

Following is the dipping, draining, stuccoing and drying sequence preparing thermal expansion test specimens No. 1 and No. 2.

| Coat No. | Slurry | Time | Stucco |
|---|---|---|---|
| | | Test No. 1 | |
| 1 | Primer | 9:30 a.m. | #7 Quartz Silica |
| 2 | Back-Up | 10:15 a.m. | #7 Quartz Silica |
| 3 | Back-Up | 11:30 a.m. | #7 Quartz Silica |
| 4 | Back-Up | 1:30 p.m. | #7 Quartz Silica |
| | | Test No. 2 | |
| 1 | Primer | 9:32 a.m. | Artificial Stucco |
| 2 | Back-Up | 10:17 a.m. | Artificial Stucco |
| 3 | Back-Up | 11:32 a.m. | Artificial Stucco |
| 4 | Back-Up | 1:32 p.m. | Artificial Stucco |

The test specimens were allowed to dry overnight. The following morning the ceramic shell test specimens prepared by repeated dipping, draining, stuccoing and drying of the wax coated metal rods were placed in an oven at 150° F. for 15 minutes. The melted wax permitted easy removal of the metal rod. In this manner two ceramic shell test specimens about 3 inches long by ½ inch long in diameter were prepared for running thermal expansion tests.

The specimens were placed in a recording diliatometer and the temperature increased from room temperature to 1800° F. over a period of 90 minutes.

The following curves show the results of these tests.

As seen in FIG. 1, the maximum linear expansion for Test No. 1 at 1800° F. was 1.60% where the quartz granules were used as stucco.

Figure 2:
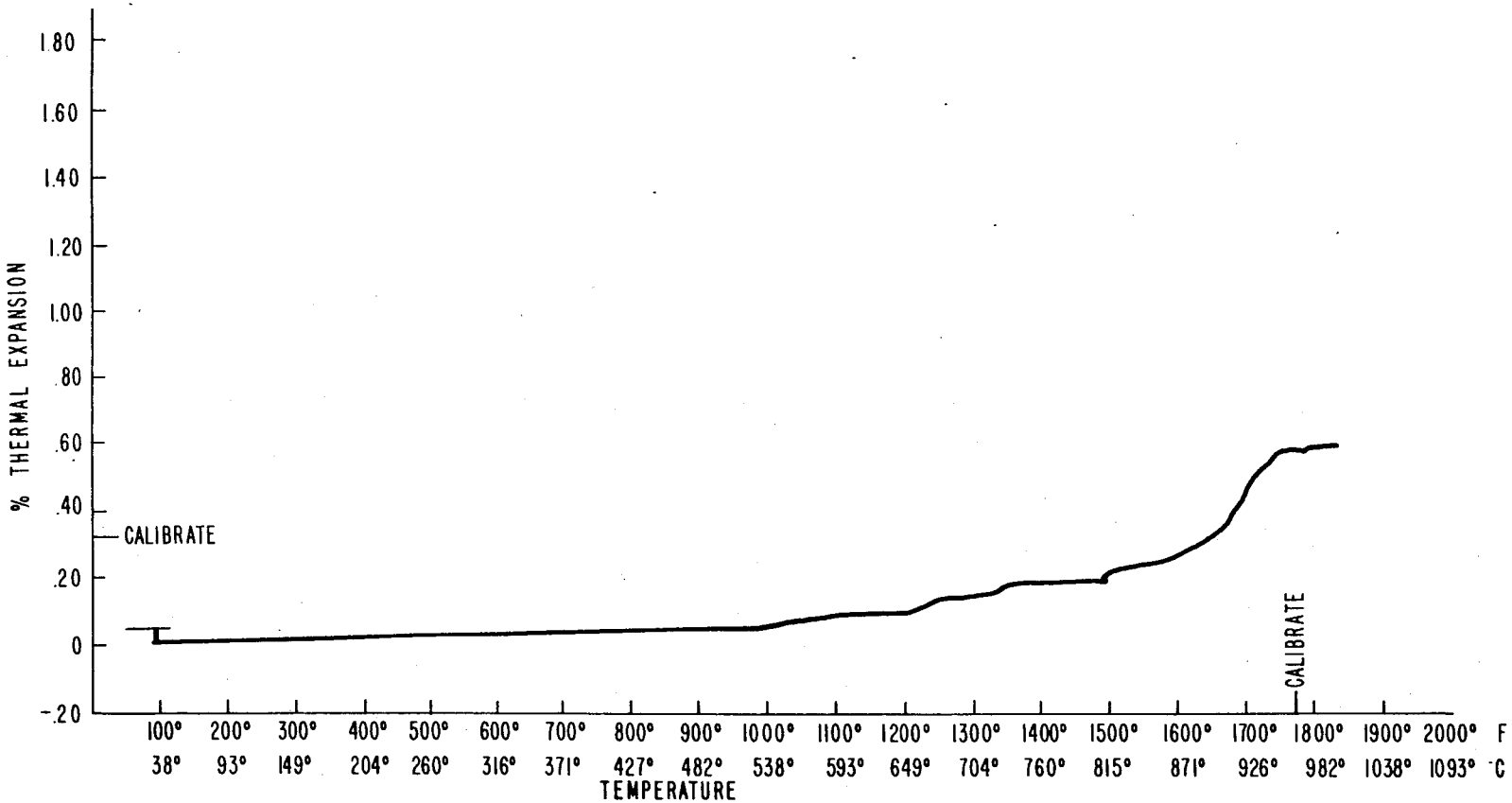

FIG. 2 demonstrates that the maximum linear thermal expansion for Test No. 2 at 1800° F. was 0.60%, where the artificial stucco of this invention was used.

This artificial stucco was the same as described above with satisfactory results from a thermal expansion standpoint. Many shell systems in commercial use today have linear thermal expansion of about 0.40%. A thermal expansion of 0.60% is still within the range that is satisfactory. However, it should be pointed out that artificial stuccoes with a wide variety of thermal expansions can be produced by various combinations of refractory powders. For example, an artificial stucco used to produce a thermal expansion of less than 0.60% can be made by using a blend of refractory powders comprising 50% 200 mesh silica flour and 50% fused silica flour. Thus it can be seen that by choosing an appropriate mixture of powders, my stucco may be produced to meet the thermal expansion requirements of various differing situations. In theory, some minimum volume of binder, relative to the volume of the refractory powder, must be present to permit expansion of the refractory particles during firing. However, my experiments with silica as the refractory powder indicate that the required proportion of binder for satisfactory preparation of the stucco is at least as high as the minimal proportion required for the desired thermal expansion properties.

The stucco of my invention may be manufactured in other ways that the pelletizing and crumbling process described herein. For example, the refractory powder, binder and any necessary solvent may be mixed to a paste and extruded, then permitted to dry. The dried extrusions are then crumbled and sieved as before. This process requires more solvent than pelletizing, which can be an advantage for certain binders, such as the starches and gums. It is also clear that by adjusting the proportions of organic binder to refractory powder, a greater or lesser friability of stucco is obtained. The strength needed in a particular application will be balanced against the necessary permeability and removability of the shell. Other factors which can be varied are the mesh size and size distribution of the refractory powder and the stucco size.

In order to make a satisfactory stucco, as was noted above, many different organic binders may be employed. For example, a solution of about 5% by weight of cornstarch in water is effective as will be seen below and so are many gelatin and mucilage solutions. Generally speaking, it is necessary that the binder be one which remains effective during and after the drying of the pellets, to bind the refractory powder together enough so that the pellets may be crumbled into stucco-sized particles without disintegrating further. In addition the binder must be sufficiently burned or destroyed by 1600° F. temperatures to no longer bind the refractory powder. The solvent for the binder can be any liquid which dissolves the binder without reacting with it or the refractory powder, and which volitalizes smoothly during the drying process. It is used in whatever proportion is sufficient for pelletizing.

Following is an example of a formula for making artificial stucco using a solution of pure corn starch in water as the organic binder and 200 mesh silica flour as the refactory powder.

The solution of corn starch was made by adding the corn starch to cold water, then heating the water to boiling with constant stirring. Heating and stirring was continued until all of the corn starch was dissolved. The solution was then allowed to cool to room temperature.

1650 ml. 5% (by wt.) soln. of corn starch in water 5000 g. 200 mesh silica flour (variations in particle size distribution may require somewhat more or less additions of silica flour to produce the desired consistency for pelletizing)

The resulting stucco material was somewhat softer than the material produced according to the formula on page 11, but it is still considered to be suitable for use as an artificial stucco.

Another example is the following formula which uses a combination of a solution of pure corn starch in water with Polyco 117SS.

1200 ml. 5% (by wt.) soln. of corn starch in water 600 ml. Polyco 117SS 5000 g. 200 mesh silica flour (variations in particle size distribution may require somewhat more or less additions of silica flour to produce the desired consistency for pelletizing)

The resulting stucco material was substantially harder than the formula using corn starch alone and is considered to be satisfactory in every respect to be used as an artificial stucco.

Although this invention has been described in its preferred form with a certain degree of particularity, it is understood that the present disclosure of the preferred form has been made only by way of example and that numerous changes in the details of the process and the combination and arrangement of layers may be resorted to without departing from the spirit and the scope of the invention as hereinafter claimed.

I claim:

1. A stucco material for use in producing shell molds for investment casting, said stucco material consisting of solid granules having a particle size of 18 to 140 mesh and consisting of silica powder and an organic binder, said powder being bound together by said binder, said binder having the property that when heated to firing temperatures used in the investment casting process, will no longer bind said silica powder together and said stucco material having the property such that the linear thermal expansion of shell molds made therefrom is not more than 0.6 percent when the molds are heated from room temperature to 1800° F.

2. The stucco material of claim 1 in which the organic binder is selected from the group consisting of polyvinyl acetate, polyvinyl alcohol, starch, and gelatin.

3. The stucco material of claim 1 having a particle size distribution of 18 to 50 mesh.

4. The stucco material of claim 1 having the following particle size distribution:

| U.S. Std. Screen | % ON |
|---|---|
| 18 mesh | 0 |
| 20 mesh | 5–20 |
| 50 mesh | 77–88 |
| Pan | max 2 |

5. The stucco material of claim 1 having the following particle size distribution:

| U.S. Std. Screen | % ON |
|---|---|
| 50 mesh | Trace |
| 120 mesh | 80–95 |
| 140 mesh | 5–20 |
| Pan | max 2% |

6. The stucco material of claim 1 in which the organic binder is polyvinyl acetate.

7. A stucco material for use in producing shell molds for investment casting, said stucco material consisting of solid granules having a particle size of 18 to 140 mesh and produced from a mixture consisting essentially of silica powder, vinyl acetate emulsion, and water, said mixture having been pelletized, dried, crumbled, and sieved, to produce said stucco material.

8. The stucco material of claim 7 in which the relative amounts in said mixture are 5000 grams of silica powder, to at least 500 ml of vinyl acetate emulsion, and sufficient added water for pelletizing.

9. The stucco material of claim 7 having a grain size distribution of 18 to 50 mesh.

10. The stucco material of claim 7 having the following grain size distribution:

| U.S. Std. sieve | % ON |
|---|---|
| 50 Mesh | Trace |
| 120 Mesh | 80–95 |
| 140 Mesh | 5–20 |
| Pan | 2 Max |

* * * * *